US006530090B1

(12) United States Patent
Ambrose et al.

(10) Patent No.: US 6,530,090 B1
(45) Date of Patent: Mar. 11, 2003

(54) PROTECTIVE GARMENT WITH GLOVE RETAINING MECHANISM

(75) Inventors: Julia Ambrose, Marietta, GA (US); Lisa Schild, Roswell, GA (US); Stacey G. McCarver, Marietta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/003,470

(22) Filed: Oct. 31, 2001

(51) Int. Cl.[7] ..... A41D 27/12
(52) U.S. Cl. ..... 2/59; 2/125
(58) Field of Search ..... 2/455, 456, 457, 2/458, 2.11, 2.14, 2.15, 59, 60, 85, 87, 93, 98, 123, 125, 129, 161.7; 128/849

(56) References Cited

U.S. PATENT DOCUMENTS 4,041,203 A * 8/1977 Brock et al. ..... 428/157
4,133,624 A * 1/1979 Heavner et al. ..... 2/159
5,414,867 A * 5/1995 Bowling et al. ..... 2/51
5,572,743 A * 11/1996 Yavitz ..... 2/125
5,594,955 A * 1/1997 Sommers ..... 2/114
5,680,653 A * 10/1997 Mathis et al. ..... 2/114
5,693,401 A * 12/1997 Sommers et al. ..... 24/16 R
5,802,609 A 9/1998 Garofalo

FOREIGN PATENT DOCUMENTS

GB 2171289 8/1986
GB 2245148 1/1992

OTHER PUBLICATIONS

EPO Search Report Oct. 18, 2002.

* cited by examiner

*Primary Examiner*—Gary L. Welch
(74) *Attorney, Agent, or Firm*—Dority & Manning

(57) ABSTRACT

A protective garment, such as a surgical gown, includes a garment body defining sleeves. A cuff may be secured at respective ends of the sleeves. A circumferentially extending band is disposed on the sleeves at a distance from the end of the sleeve or cuff. The band has a raised profile such that an end of a glove pulled over the band is inhibited from rolling or sliding back over the band and down the sleeve. The band may be formed of a low-tack surface modifier. The sleeve may also include a coating or application of a surface modifier, such as a low-tack adhesive, applied to the region between the band and cuff or sleeve end.

20 Claims, 3 Drawing Sheets

PROTECTIVE GARMENT WITH GLOVE RETAINING MECHANISM

FIELD OF THE INVENTION

The present invention relates generally to protective garments for use with gloves, for example surgical gowns used with surgical gloves.

BACKGROUND

Protective garments, such as coveralls and gowns, designed to provide barrier protection to a wearer are well known in the art. Such protective garments are used in situations where isolation of a wearer from a particular environment is desirable, or it is desirable to inhibit or retard the passage of hazardous liquids and biological contaminates through the garment to the wearer.

In the medical and health-care industry, particularly with surgical procedures, a primary concern is isolation of the medical practitioner from patient fluids such as blood, saliva, perspiration, etc. Protective garments rely on the barrier properties of the fabrics used in the garments, and on the construction and design of the garment. Openings or seams in the garments may be unsatisfactory, especially if the seams or openings are located in positions where they may be subjected to stress and/or direct contact with the hazardous substances.

Gloves are commonly worn in conjunction with protective garments, particularly in the medical industry. Typically, the gloves are pulled up over the cuff and sleeve of a gown or garment. However, the interface between the glove and the protective garment can be an area of concern. For example, a common issue with surgical gloves is glove "roll-down" or slippage resulting from a low frictional interface between the interior side of the glove and the surgical gown sleeve. When the glove rolls down or slips on the sleeve, the wearer is at greater risk of exposure to patient fluids and/or other contaminants.

An additional problem associated with the use of surgical gloves is that as a result of the gloves being pulled up over the cuff and sleeve of the gown, a phenomenon known as "channeling" occurs. That is, the sleeve of the gown is bunched up under the glove as a result of pulling and rolling the glove up over the cuff and sleeve. Channels may develop along the wearer's wrist which may become accessible to patient fluids running down the outside of the sleeve of the gown. Such fluids may enter the channels and work down along the channels between the outer surface of the gown and inner surface of the surgical glove. The fluids may then contaminate the gown cuff, which lies directly against the wearer's wrist or forearm, particularly if the cuff is absorbent or fluid pervious.

Surgeons and other medical personnel have attempted to address concerns with the glove and gown interface in different ways. For example, it has been a common practice to use adhesive tape wrapped around the glove portion extending over the gown sleeve to prevent channels and roll down of the glove on the sleeve. This approach has drawbacks though. Many of the common adhesives utilized in tapes are subject to attack by water and body fluids and the seal can be broken during a procedure. It has also been known to stretch a rubber band around the glove and sleeve. However, this practice is awkward to implement and difficult to adjust or vary the pressure exerted by the rubber band other than by having a variety of rubber bands of different sizes and tensions available for use.

Thus, a need exists for an improved device and method for providing an effective sealing interface between a glove and sleeve of a protective garment, wherein the device is easily incorporated with the protective garment and economically cost effective to implement and practice.

SUMMARY

Objects and advantages of the invention will be set forth in part in the following description, or may be obvious from the description, or may be learned through practice of the invention.

The present invention provides a protective garment incorporating an effective and economical mechanism for improving the interface area between the sleeves of the garment and a glove pulled over the sleeves. The improvement inhibits the proximal end of the glove from rolling or sliding back down the garment sleeves once the wearer has pulled the gloves on. In this way, the garment according to the invention addresses at least certain of the disadvantages of conventional garments discussed above.

It should be appreciated that, although the present invention has particular usefulness as a surgical gown, the invention is not limited in scope to surgical gowns or the medical industry. The protective garment according to the present invention has wide application and can be used in any instance wherein a protective coverall, gown, robe, etc., is used with gloves. All such uses and garments are contemplated within the scope of the invention.

In an embodiment of the invention, a protective garment is provided having a garment body. The garment may be, for example, a surgical gown, a protective coverall, etc. The garment body includes sleeves, and the sleeves may have a cuff disposed at the distal end thereof. The cuffs may be formed from or include an elastic material, and may be liquid retentive or liquid impervious.

In a broad aspect of the invention, a circumferentially extending band is formed on the sleeves at a distance from the distal end of the sleeve or proximal end of the cuff. This band has a raised profile with respect to the sleeve material such that an end of a glove pulled over the band is inhibited from rolling or sliding back over the band and down the sleeve. Conventional surgical gloves and other types of stretchable protective gloves often have a thickened portion or "roll" at the distal end thereof. The present invention takes advantage of this feature by incorporating the raised profile band at a distance from the sleeve end. A wearer pulls the glove on and over the garment sleeve until the distal end of the glove passes over the raised profile band. The band thus acts as a "bumper" or stop against which the thickened portion of the glove contacts if it starts to slide or roll down the garment sleeve and thus inhibits further movement of the glove on the sleeve.

It should be appreciated that various configurations of the raised profile band are possible. For example, in one embodiment, the band may be continuously formed around the sleeve, for example in the form of one or more raised rings. In another embodiment, the band may be discontinuous around the sleeve, for example in the form of a ring of beads or bumps. A vast number of other configurations are also suitable.

In one particular embodiment, the raised profile band is formed from a surface modifier material applied to the garment fabric, for example by spraying, coating, etc. This material may be of a type to enhance (increase) surface friction between the glove and band. For example, the band may be formed from a low-tack adhesive material applied to the sleeve.

In a further embodiment, it may be desirable to apply the surface modifier, particularly a low-tack material, to an area of the sleeve between the raised profile band and the distal end of the sleeve or proximal end of the cuff. This additional material would further increase the frictional interface between the glove and sleeve.

The "low-tack" material applied to the band and/or sleeve is desirably an inherently low-tack substance with high friction characteristics so as to prevent glove roll-down while not causing the sleeves to adhere to the gown body when the gown is folded.

Embodiments of the protective garment according to the invention are described below in greater detail with reference to the appended figures.

DETAILED DESCRIPTION

Reference will now be made in detail to one or more examples of the invention depicted in the figures. Each example is provided by way of explanation of the invention, and not meant as a limitation of the invention. For example, features illustrated or described as part of one embodiment may be used with another embodiment to yield still a different embodiment. Other modifications and variations to the described embodiments are also contemplated within the scope and spirit of the invention.

Figure 1:
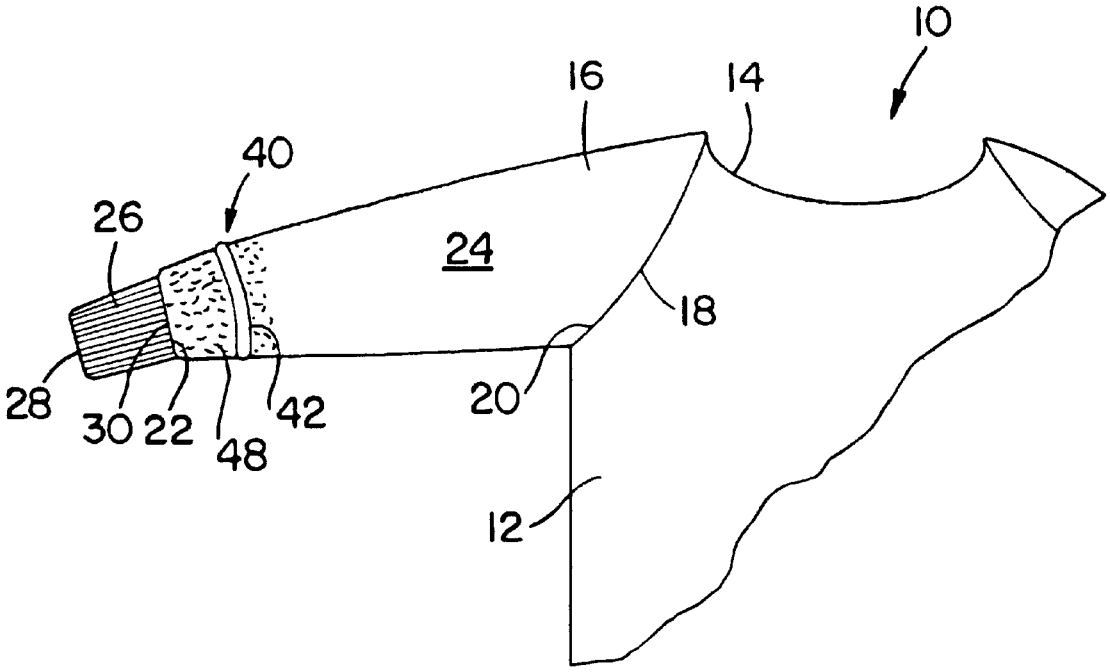
FIG. 1 is a partial side view of an embodiment of a protective garment according to the present invention.
Figure 2:
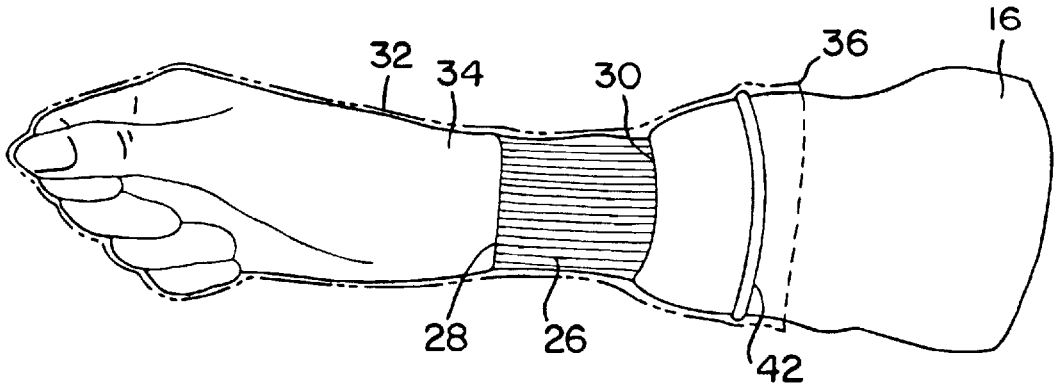
FIG. 2 is a partial perspective view of a garment sleeve according to an embodiment of the present invention.

FIG. 1 illustrates a protective garment 10 according to the invention. The garment 10 includes a main body portion 12, a neck portion 14, and sleeves 16 (one sleeve shown) attached to the main body portion 12 at a seam 18. The sleeves 16 may also be formed as an integral component with the main body portion 12. Each sleeve 16 may include an upper or proximal end 20, a lower or distal end 22, and an exterior surface 24.

The garment 10 is depicted as a surgical gown for illustrative purposes only. The garment 10 may be any type or style of protective covering that is generally worn about the body and includes sleeves.

The terms "lower" or "distal" are used herein to denote features that are closer to the hands of the wearer. The terms "upper" or "proximal" are used to denote features that are closer to the shoulder of the wearer.

It should be appreciated that the type of fabric or material used for garment 10 is not a limiting factor of the invention. The garment 10 may be made from a multitude of materials, including nonwoven materials suitable for disposable use. For example, gown embodiments of the garment 10 may be made of a stretchable nonwoven material so that the gown is less likely to tear during donning or wearing of the gown. A material particularly well suited for use with the present invention is a three-layer nonwoven polypropylene material known as SMS. "SMS" is an acronym for Spunbond, Meltblown, Spunbond, the process by which the three layers are constructed and then laminated together. See for example U.S. Pat. No. 4,041,203 to Brock et al. One particular advantage is that the SMS material exhibits enhanced fluid barrier characteristics. It should be noted, however, that other nonwovens as well as other materials including wovens, films, foam/film laminates, and combinations thereof may be used to construct the garment of the present invention. It is also contemplated that the garment may be coated with a liquid impervious coating to prevent fluid absorption into the garment material.

The sleeves 16 may incorporate a cuff 26 attached to the distal end 22 thereof. The cuff has a distal end 28 and a proximal end 30. The configuration and materials used in the cuff 26 may vary widely. For example, short, tight-fitting cuffs made from a knitted material may be provided. The cuff 26 may be formed with or without ribs. The cuff may be formed of a liquid repellant material or a liquid retentive material. Cuffs suitable for use with garments according to the present invention are described in U.S. Pat. Nos. 5,594,955 and 5,680,653, both of which are incorporated herein in their entirety for all purposes.

As shown for example in FIGS. 2–5, protective garments are frequently used with gloves, such as a surgical glove 32 that is pulled over the hand of the wearer and has a sufficient length so that a proximal portion of the glove 32 overlaps the cuff 26 and a portion of the sleeve 16. An interface is thus established between the glove interior surface and the exterior surface 24 of the sleeve 16 and cuff 26. This interface region preferably inhibits undesirable fluids or other contaminants from running down the sleeve 16 to the cuff 26 or hand 34 of the wearer. However, glove slippage or roll-down occurs if the frictional interface between the glove interior surface and the sleeve exterior surface is insufficient to maintain the glove in position above the cuff 26. When glove roll-down occurs, the wearer is at greater risk of exposure to contaminants, particularly during a surgical procedure.

Many types of protective gloves, particularly elastic synthetic or natural rubber surgical gloves, have a thickened bead or region at the open proximal end 36. This thickened portion or bead is intended to strengthen the glove 32 and provide an area of increased elastic tension to aid in holding the glove 32 up on the sleeve 16. The present invention takes advantage of this feature of the gloves.

According to one embodiment of the invention, the garment 10 includes a circumferentially extending "band" 40 formed on the sleeves 16 at a distance from the proximal end 30 of the cuff 26. The band 40 is spaced from the cuff 26 at a distance so that the thickened proximal end 36 of the glove 32 extends past the band 40 in normal donning and use of the gloves. The band 40 has a raised profile as compared to the exterior surface 24 of the sleeve 16 on either side of the band 40 so as to form a ridge or bump around the sleeve 16. The band 40 thus acts as a bumper or stop against which the thickened proximal end 36 of the glove 32 contacts if the glove tends to slip down the exterior surface 24 of the glove. The raised profile of the band 40 inhibits further slippage or roll-down of the glove 32.

Figure 3:
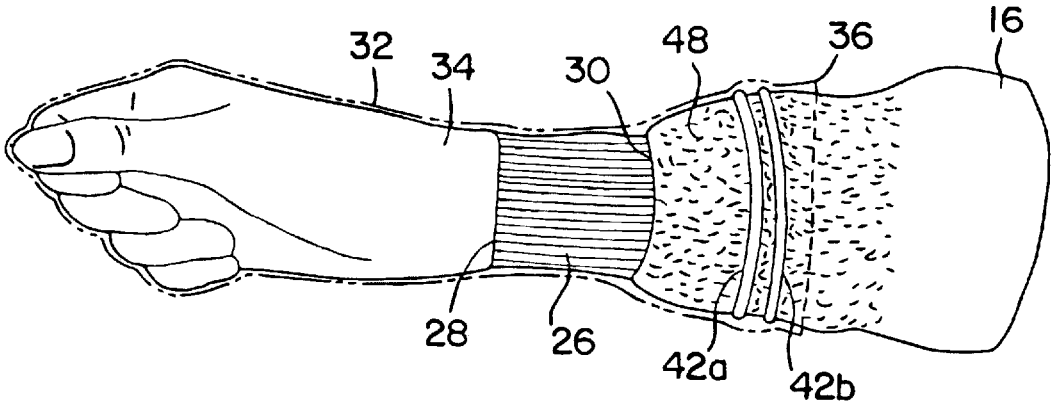
FIG. 3 is a partial perspective view of an alternative garment sleeve according to an embodiment of the invention.

It should be appreciated that the band 40 can take on many different configurations. For example, the band 40 may be continuous around the sleeve 16, such as a continuous ring 42 (FIG. 2) or plurality of rings 42*a*–42*b* (FIG. 3). The band may be discontinuous around the sleeve 16, such as a ring of beads 44 (FIG. 4) or wide strip of beads or broken segments 46 (FIG. 5). The particular structural configuration of the raised profile band 40 may vary widely so long as a generally circumferentially extending area or region having an overall raised profile is provided, with the raised profile being sufficient to inhibit glove slippage or roll-down.

The band 40 may be formed on the sleeve in various known ways and from a variety of materials. For example, a surface modifier compatible with the sleeve material may be applied directly to the sleeve in a spraying, printing, slot coating, or other conventional process.

To further increase the frictional interface between the glove interior surface and the exterior surface of the sleeve, the band 40 may be formed of aninherently low-tack material with high frictional characteristics, such as a low-tack hot melt adhesive. This type of material increases slip resistance between the glove and sleeve 16 and may be applied directly onto the exterior surface 24 of the sleeve to form the raised profile band 40. In general, the surface modifier could be any polymer that is sufficiently soft and pliable so as to cling to the inside surface of the glove 32. At the same time, the polymer should not have too high a tack level so as to cause the garment sleeve 16 to stick to the garment body 12 when the garment 10 is folded. Polymers such as metallocene based polyolefins (i.e., Dow XU 58380.01L) are suitable examples. Other suitable surface modifiers include, for example, ethylene vinyl acetate copolymers, styrene-butadiene, cellulose acetate butyrate, ethyl cellulose, synthetic rubbers including, for example, Krayton™ block copolymers, natural rubber, polyethylenes, polyamides, flexible polyolefins, and amorphous polyalpha-olefins. A suitable commercial hot melt adhesive for this application is REXtac® 2115 APAO (Amorphous PolyAlpha Olefin) from Huntsman Polymers Corp. of Odessa, Tex.

Figure 4:
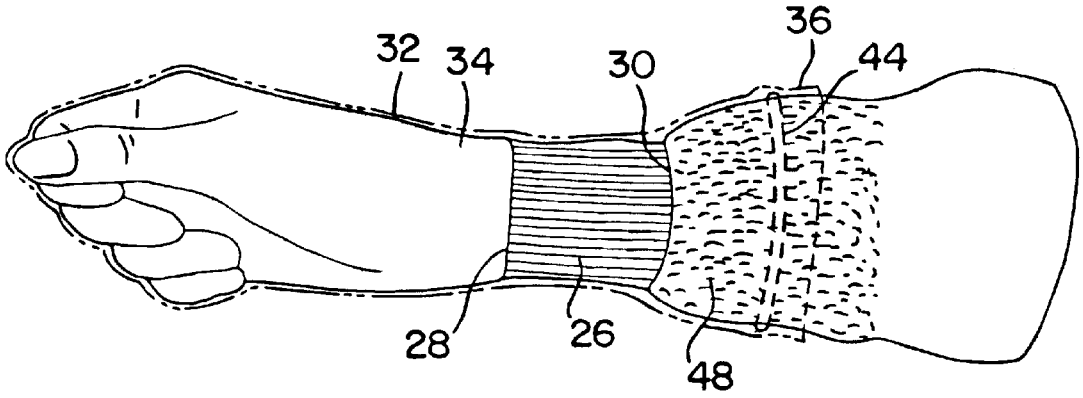
FIG. 4 is a partial perspective view of another garment sleeve according to an embodiment of the present invention.
Figure 5:
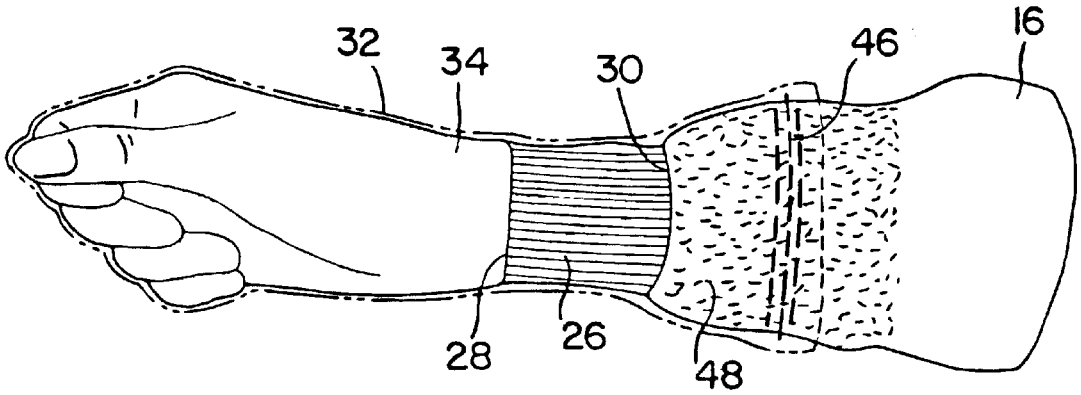
FIG. 5 is a partial perspective view of yet a different garment sleeve according to an embodiment of the present invention.

To further enhance frictional resistance between the glove 32 and sleeve 16, it may be desired to also apply the low-tack surface modifier as a surface coating 48 on a portion of the sleeve 16 proximal to the cuff 26, as illustrated in FIGS. 3–5. This coating 48 may be continuous, such as a film layer or coating, or discontinuous, such as a printed pattern. The coating 48 may be applied by any suitable process, including spraying, printing, coating, or other conventional process. The coating 48 may be the same low-tack surface modifier used to form the raised profile band 40, or a different surface modifier. The coating 48 may extend up the sleeve 16 a distance greater than the proximal end 36 of the glove 32 extends when the glove is normally donned.

It should be appreciated by those skilled in the art that various modifications and variations can be made to the embodiments of the present invention described and illustrated herein without departing from the scope and spirit of the invention. The invention includes such modifications and variations coming within the meaning and range of equivalency of the appended claims.

What is claimed is:

1. A protective garment, comprising:

a garment body, said garment body defining sleeves;

a cuff secured at respective ends of said sleeves;

a circumferentially extending band of a first low-tack material applied to said sleeves at a distance from said cuffs, said band comprising a raised profile such that an end of a glove pulled over said band is inhibited from rolling or sliding back over said band; and wherein said band is continuous around said sleeves.

2. The protective garment as in claim 1, wherein said garment body is a surgical gown.

3. The protective garment as in claim 1, wherein said band is formed at least in part by an adhesive applied onto said sleeves.

4. The protective garment as in claim 1, wherein said band comprises at least one continuous ring of said low-tack material.

5. The protective garment as in claim 1, wherein said band comprises a plurality of rings of said low-tack material.

6. The protective garment as in claim 1, further comprising a second disposition of low-tack material applied to said sleeves at least between said cuffs and said bands.

7. The protective garment as in claim 6, wherein said first and second low-tack materials are the same material.

8. The protective garment as in claim 7, wherein said low-tack material is an adhesive.

9. A protective garment, comprising:

a garment body, said garment body defining sleeves; and a circumferentially extending band formed on said sleeves at a distance from a distal end of said sleeves, said band comprising a raised profile such that an end of a glove pulled over said band is inhibited from rolling or sliding back over said band; and an area of a low-tack material applied to an outer surface of said sleeves between said circumferentially extending band and said distal end of said sleeves.

10. The protective garment as in claim 9, wherein said band is formed from a surface modifier material applied to a surface of said sleeves.

11. The protective garment as in claim 10, wherein said surface modifier enhances surface friction of said band.

12. The protective garment as in claim 11, wherein said surface modifier is an adhesive.

13. The protective garment as in claim 9, wherein said band is continuous around said sleeves.

14. The protective garment as in claim 9, wherein said garment body is a surgical gown.

15. The protective garment as in claim 9, further comprising a cuff configured at the distal end of said sleeves, said band disposed proximal to said cuffs.

16. A surgical gown, comprising:

a gown body with sleeves;

a cuff secured at respective ends of said sleeves;

a circumferentially extending area of low-tack material applied to said sleeves proximal to said cuffs; and a circumferentially extending raised profile band formed on said sleeves proximal to said cuff such that an end of a glove pulled over said band is inhibited from rolling or sliding back over said band.

17. The surgical gown as in claim 16, wherein said band is disposed at a proximal end of said area of low-tack material.

18. The surgical gown as in claim 16, wherein said band is formed at least in part of said low-tack material.

19. The surgical gown as in claim 16, wherein said band is continuous around said sleeves.

20. The surgical gown as in claim 19, wherein said band comprises at least one ring of said low-tack material.

* * * * *